US006675995B2

(12) United States Patent
Stull et al.

(10) Patent No.: US 6,675,995 B2
(45) Date of Patent: Jan. 13, 2004

(54) TRAVERSING TWIST CAP

(75) Inventors: Gene Stull, Far Hills, NJ (US); Robert T. Auer, East Stroudsburg, PA (US)

(73) Assignee: Stull Technologies, Inc., Somerset, NJ (US)

( * ) Notice: Subject to any disclaimer, the term of this patent is extended or adjusted under 35 U.S.C. 154(b) by 0 days.

(21) Appl. No.: 09/875,430

(22) Filed: Jun. 5, 2001

(65) Prior Publication Data

US 2003/0094430 A1 May 22, 2003

Related U.S. Application Data

(60) Provisional application No. 60/209,728, filed on Jun. 5, 2000.

(51) Int. Cl.[7] ..... B67D 5/06
(52) U.S. Cl. ..... 222/520; 215/313; 215/314
(58) Field of Search ..... 215/313, 314, 215/320, 318, 321; 222/549, 520, 519

(56) References Cited

U.S. PATENT DOCUMENTS 2,165,825 A * 7/1939 Von Bultzingslowen .... 222/519
2,533,915 A * 12/1950 Brooks ..... 222/520
2,943,771 A * 7/1960 Driscoll ..... 222/548
3,231,155 A * 1/1966 McConnell ..... 222/549
3,430,798 A * 3/1969 Goyet et al. ..... 215/320
3,606,105 A * 9/1971 Santore ..... 222/520
5,135,139 A * 8/1992 Krawagna ..... 222/520
6,394,295 B2 * 5/2002 Claude ..... 215/318

* cited by examiner

*Primary Examiner*—Nathan J. Newhouse
(74) *Attorney, Agent, or Firm*—Katten Muchin Zavis Rosenman

(57) ABSTRACT

There is provided according to the present invention, a rotary valve cap and container comprising a cap portion having an inner sidewall with guide bosses disposed thereon and a sealing skirt disposed from the top of the cap concentric with the inner sidewall, and a container neck portion having an inner and an outer sidewall, wherein the outer sidewall has an undulating bead thereon, such that said guide bosses engage said undulating bead for raising and lowering said cap such that said sealing skirt is sealably engages said container neck.

8 Claims, 2 Drawing Sheets

TRAVERSING TWIST CAP

RELATED APPLICATIONS

This application claims priority of Provisional No. 60/209,728, filed on Jun. 5, 2000, which is incorporated herein by reference in its entirety.

BACKGROUND OF INVENTION

1. Field of the Invention

This invention relates to a resealable rotary dispensing cap which is particularly well suited for dispensing liquids and particulate matter and method of making and using same.

2. Brief Statement of the Prior Art

The term "container" as used herein and in the claims, is to be interpreted as being inclusive of glass or plastic bottles, metallic cans, jars, cups, bottles and the like.

The term "cap" as used herein and in the claims, is to be interpreted as being inclusive of a cap closure such as a snap fit, push-pull, twist open, or the like, used for providing a closure over a container as described above.

Plastic dispensing caps for containers such as plastic and glass bottles and plastic tubes are well established products with many years of development and commercial use. A problem which has not been satisfactorily resolved by the prior art designs is to provide a one piece resealable dispensing cap that can be manufactured by forming parts having a simple design which can be used with equal effectiveness for dispensing liquids and particulate matter, having adequate seals to prevent leakage of contents of the container, without the need for intricately shaped parts that are difficult and expensive to manufacture.

A need therefore exists and it is an object of this invention to provide a resealable dispensing cap.

It is another object of this invention to provide a resealable dispensing cap, which is particularly well suited for dispensing liquids and particulate matter.

It is yet another object of this invention to provide a resealable dispensing cap that can be opened and closed by rotating the cap about its axis to provide an infinitely variable spout opening between the fully opened and closed limits.

It is yet another object of this invention to provide a resealable dispensing cap that can be opened and closed by rotating the cap about its axis having a spout opening that is free from obstruction or flow restriction.

It is yet another object of this invention to provide a resealable dispensing cap having a simple design without intricate parts that provides adequate sealing of the contents.

It is yet another object of this invention to provide a resealable dispensing cap wherein the sealing housing is permanently affixed to the container neck.

It is yet another object of this invention to provide a resealable dispensing cap wherein the sealing housing provides detents to provide ease of use.

Other objects, features, and advantages of the present invention will become apparent from the following detailed description, the accompanying drawings, and the appended claims.

SUMMARY OF THE INVENTION

To meet the above expressed needs and objects, this invention provides a one-piece injection molded rotary cap that can be turned about its axis in either direction, to open or close the nozzle channel. The cap skirt is designed to snap over an undulating convex/concave bead. Located on the inside of the cap skirt walls are two sets of snaps that are located 180 degrees directly opposite each other. Both sets of snaps fit over and under the container bead. The 360-degree continuous undulated bead is molded with two parallel offsetting segments that are of equal distance up and down, top and bottom. The continuous bead or track is molded in one consistent thickness. In an exemplary embodiment of the present invention, the two valleys and two peaks on the bead track are 180 degrees opposite each other. When the cap is turned it automatically opens and closes the dispensing track by following the up and down fluctuations on the bead track. The inner sealing ring opens and closes as the cap moves up and down, causing the inner ring to slide in and out of the inner wall of the container neck. Dispensing product is done by turning the cap to an open position, tipping the container on its side or upside down and applying pressure to the sidewalls of the container, thereby decreasing the volume of the container and increasing the pressure inside the container to force product through the opening.

Therefore, there is provided according to the present invention, a rotary valve cap and container comprising a cap portion having an inner sidewall with guide bosses disposed thereon and a sealing skirt disposed from the top of the cap concentric with the inner sidewall, and a container neck portion having an inner and an outer sidewall, wherein the outer sidewall has an undulating bead thereon, such that said guide bosses engage said undulating bead for raising and lowering said cap such that said sealing skirt is sealably engages said container neck.

DESCRIPTION OF THE DRAWINGS

The invention will be described with reference to the figures of which.

DESCRIPTION OF THE PREFERRED EMBODIMENT

As will be appreciated, the resealable rotary dispensing cap can be of other configurations consistent with the descriptions herein. Therefore the device of the present invention, while not limited thereto, has for purposes of illustration and description been presented to conform to the drawings attached hereto.

Figure 1:
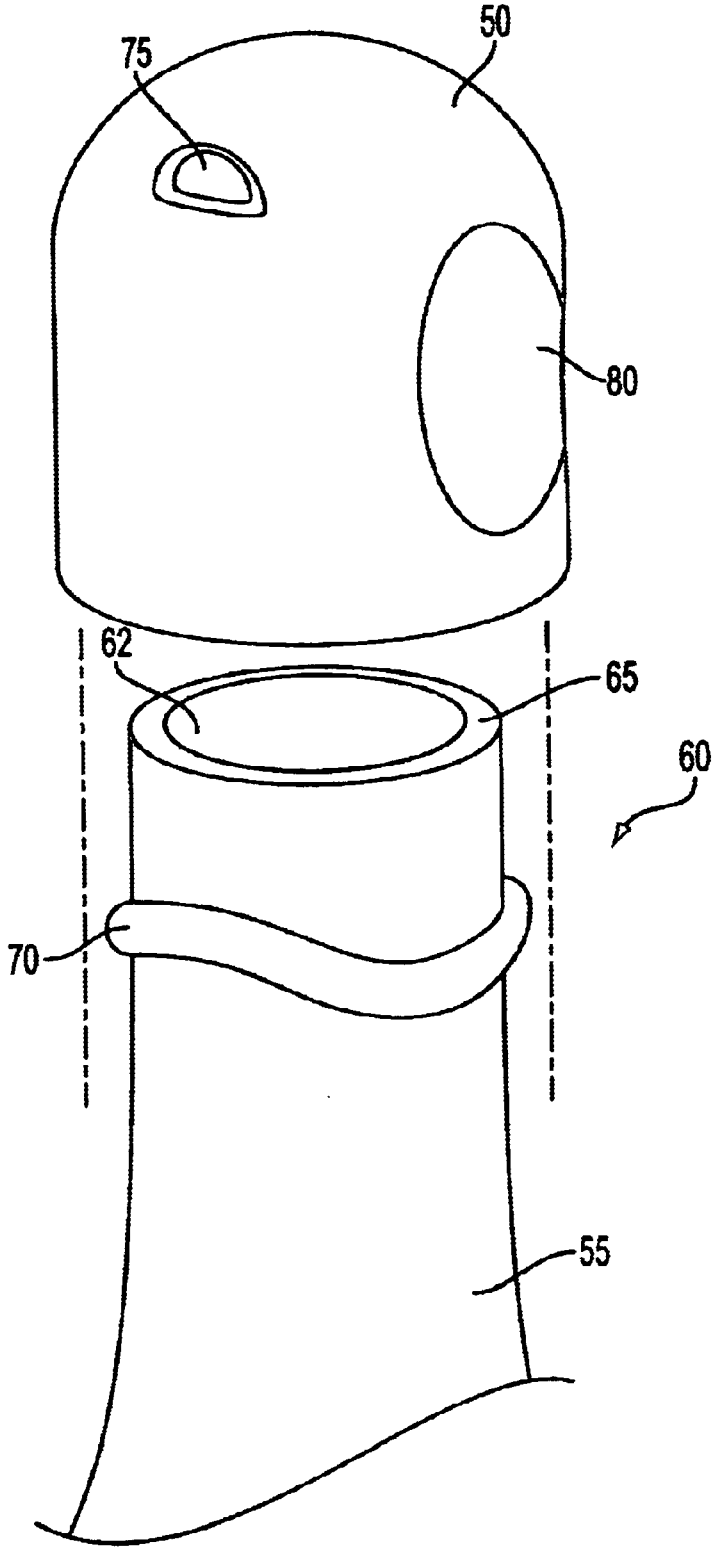
FIG. 1 is an exploded, three-dimensional view of a rotary valve cap of the present invention positioned above a container neck of the present invention.
Figure 2:
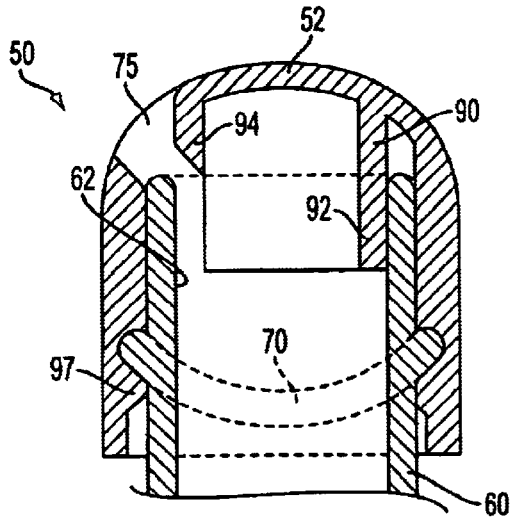
FIG. 2 is an elevational cross section view of the rotary valve cap of the invention in an open position on a container neck.
Figure 3:
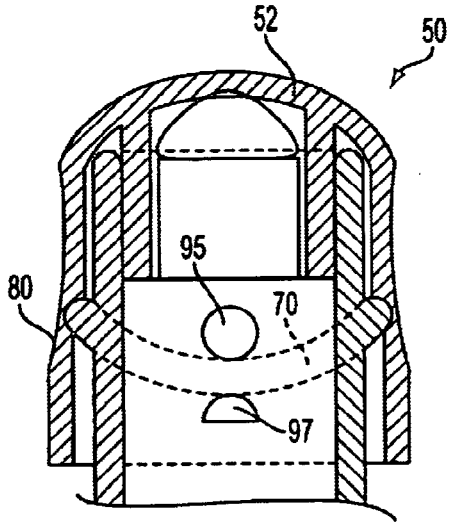
FIG. 3 is an elevational cross section view of the rotary valve cap of the invention in a closed position on a container neck.
Figure 4:
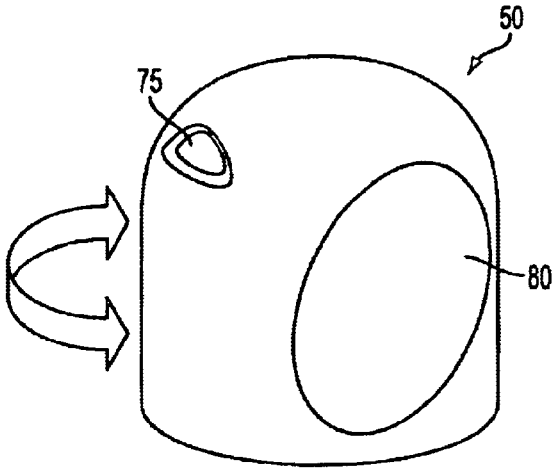
FIG. 4 is elevational view of the rotary valve cap of the invention.
Figure 5:
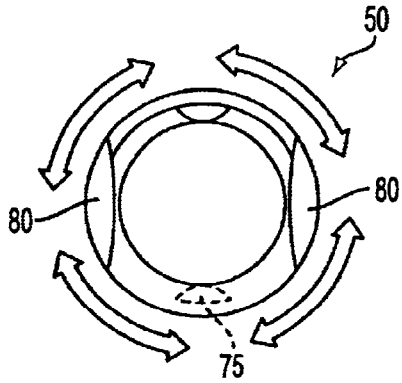
FIG. 5 is an overhead plan view of the rotary valve cap of the invention.

In accordance with the present invention as illustrated in FIGS. 1–5, a rotary valve cap 50 is used for closing and sealing a bottle, or other container 55, having a neck 60 including a lip 65 surrounding the pouring opening. The neck 60 of the container 55 has thereon an undulating bead 70 for raising and lowering the cap 50. The undulating bead

70 is continuously disposed about the outer diameter of the container neck 60 and having two concave portions and two convex portions each portion separated by a point of inflection. The peak of each convex portion is disposed about the container neck at a point that is separated by 90 degrees from the valley of each concave portion.

The rotary valve cap 50 is adapted to fit over the neck 60 of the container 55. The cap 50 has a nozzle or opening 75 for allowing product (not shown) to flow from the container 55 disposed on the sidewall of the rotary valve cap 50. On the outer surface, there are two finger detents 80 to provide easy of gripping. Alternately, one skilled in the art could see that the detents could be replaced or modified to provide other means of grip assistance. There is a sealing skirt member 90 disposed concentrically inside the cap sidewall from the top of the cap cover 52 extending down. On the inner sidewall of the cap there are located guide bosses adapted to fit over the undulating bead 70 that lock the cap 50 in place on the container neck 60. There are provided two pairs of upper and lower guide bosses 95 and 97 respectively. The lower guide bosses 97 are disposed such that they engage the lower edge of the undulating bead 70, while the upper guide bosses 95 are disposed such that they engage the upper edge of the undulating bead 70. Each pair of upper and lower guide bosses 95 and 97 respectively are located on the inner sidewall of the cap 50 at points separated by 180 degrees, such that each pair of guide bosses 95, 97 rides on the corresponding opposite portion of the undulating bead 70. For example, when one pair of guide bosses is riding on the peak of one convex portion of the undulating bead 70, the second pair of guide bosses in riding on the peak of the other convex portion of the undulating bead 70. The guide bosses of the rotary valve cap 50 fit over the undulating bead 70 such that as the cap 50 is rotated the guide bosses ride on the bead 70 to raise and lower the cap 50.

The annular sealing skirt 90 is disposed from the top 52 of the inside surface of the cap 50 and extends down from the cap top 52, engaging the inside 62 of the container neck 60. The outer diameter of the sealing skirt 90 bears against the inner diameter 62 of the container neck 60, thereby forming a seal. The sealing skirt walls extend down from the top 52 of the cap 50 such that there are two long skirt wall portions 92 and two short skirt 94 wall portions, each separated by 90 degrees. The short skirt wall portions 94 are located in alignment with the guide bosses 95, 97 such that then the guide bosses 95, 97 ride on the two peaks of the undulating bead 70, the short sealing skirt wall 94 disengages from the container neck 60, thereby providing a passage for the product to flow out of the nozzle 75. One skilled in the art can see that the sealing skirt 90 can be modified such that the short portion 94 has a circumference that is greater or less that 90 degrees about the axis of the cap, thereby providing a larger or smaller product passage 96. Likewise the undulating bead 70 can also be modified to have only one peak and thus only one open position, or more than two peaks and thus more than two open positions.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A rotary valve cap and container comprising:

a cap having a dispensing nozzle, an inner sidewall, upper and lower guide bosses disposed on said inner sidewall and a sealing skirt downwardly disposed from the top of the cap concentric with said inner sidewall, said sealing skirt provided with a dispensing passage, a container neck portion having an inner sidewall and an outer sidewall and a continuous, undulating bead provided on said outer sidewall of said container neck, wherein said cap is retained on said container neck through the engagement of said upper and lower guide bosses with said undulating bead such that rotation of said cap results in the raising and lowering of said cap relative to said container neck and does not result in the removal of said cap from said container neck, wherein said upper and lower guide bosses control the rotation said cap between a raised, open position and a lowered, closed position relative to said container neck, wherein when said cap in the closed position, said sealing skirt sealably engages said container neck and passage of container material through said dispensing passage is prevented, and wherein when said cap in the open position, said dispensing passage is in dispensing communication with said cap nozzle to allow for the dispensing of container material through said cap nozzle.

2. A rotary valve cap and container in accordance with claim 1, wherein said cap is rotatable 360° in the clockwise and counter-clockwise directions relative to said container neck.

3. A rotary valve cap and container in accordance with claim 1, wherein said cap further comprises two open positions 180° apart.

4. A rotary valve cap and container in accordance with claim 3, wherein said cap further comprises two closed positions 180° apart.

5. A rotary valve cap and container in accordance with claim 1, wherein said cap further comprises two closed positions 180° apart.

6. A rotary valve cap and container in accordance with claim 1, wherein said cap is rotatable between the open and closed positions in 90° intervals relative to the container neck.

7. A rotary valve cap and container in accordance with claim 1, wherein said cap is rotatable both clockwise and counter-clockwise between the open and closed positions in 90° intervals relative to the container neck.

8. A rotary valve cap and container in accordance with claim 1, further comprising finger detents provided on an outer surface of said cap.

* * * * *